US006357379B1

(12) United States Patent
Murphy, Jr.

(10) Patent No.: US 6,357,379 B1
(45) Date of Patent: Mar. 19, 2002

(54) RETRACTABLE/DEPLOYABLE ENCLOSURE ASSEMBLY FOR A WATERCRAFT VEHICLE

(76) Inventor: Charles Murphy, Jr., 440 Rue de la Riviere Dr., Kenner, LA (US) 70065

( * ) Notice: Subject to any disclaimer, the term of this patent is extended or adjusted under 35 U.S.C. 154(b) by 0 days.

(21) Appl. No.: 09/846,785

(22) Filed: May 1, 2001

(51) Int. Cl.[7] ..... B63B 17/00
(52) U.S. Cl. ..... 114/361
(58) Field of Search ..... 114/343, 361, 114/201 R, 202

(56) References Cited

U.S. PATENT DOCUMENTS

| | | | |
|---|---|---|---|
| 1,663,347 | A | 3/1928 | Miller |
| 3,165,762 | A | 1/1965 | Hage |
| 3,857,601 | A | 12/1974 | Robbins |
| 4,425,861 | A | 1/1984 | Raikamo |
| 4,582,016 | A | 4/1986 | Hansen |
| 4,685,411 | A | 8/1987 | Wick |
| 4,715,312 | A | 12/1987 | Bouvart |
| 5,088,438 | A | 2/1992 | Richardson, Jr. |

FOREIGN PATENT DOCUMENTS

| | | |
|---|---|---|
| JP | 55-72490 | 5/1980 |
| WO | WO 94/06676 | 3/1994 |

OTHER PUBLICATIONS

Pike, Bill, "Born to be Wild", Power and Motor Yacht; Apr. 2000; 16(4): 58–61.

Reininger, Stuart, "On the Rampage", Power and Motor Yacht; Sep. 1999; 15(9): 78–82.

*Primary Examiner*—Ed Swinehart
(74) *Attorney, Agent, or Firm*—Raymond G. Areaux; Lisa Valez

(57) ABSTRACT

A retractable/deployable enclosure assembly for an open stern of a watercraft vehicle comprising a plurality of foldable sidewalls and a foldable or retractable roof which are adapted to be stowed within recesses of the pre-existing hull. The sidewalls may be stored in storage berths located under either the gunnel cap or the deck of the watercraft vehicle. The sidewalls are lifted from their respective storage berths by telescoping hydraulic lifting assemblies located in the berths wherein, as the sidewalls are lifted, sidewall sections of the sidewall are unfolded. The roof is pulled from a storage berth located under a flybridge deck into a fully horizontally erect extension of the flybridge once the sidewalls are fully deployed. The roof is adapted with a locking mechanism to prevent over-deployment once the end of the sidewall is reached. Lastly, seals may be used and are manually inserted over any remaining openings.

20 Claims, 9 Drawing Sheets

RETRACTABLE/DEPLOYABLE ENCLOSURE ASSEMBLY FOR A WATERCRAFT VEHICLE

TECHNICAL FIELD

The present invention relates to temporary shelters or enclosures for watercraft vehicles and, more particularly, a retractable/deployable enclosure assembly for a watercraft vehicle which includes a roof adapted to be ejected and deployed from the floor of a flybridge and sidewalls raised from the hull of the watercraft vehicle. Moreover, the sidewalls are formed of stackable and linked independent sections which, when deployed, maintain a vertically erect sidewall and, when retracted, are generally concealed under the gunnel or floor of the watercraft vehicle.

BACKGROUND OF THE INVENTION

Millions of dollars are spent building watercraft vehicles which are able to either cruise or fish. Some fishing boats have a cabin area which may be at least partially enclosed and an open stern to permit fishing. Additionally, some fishing boats have an elevated flybridge from which the boat may be navigated. These fishing boats are not manufactured with the same amenities as a yacht designed for cruising, Yachts for cruising typically provide for a fully enclosed cabin and stern.

Several devices have been patented which are directed to temporary watercraft enclosures.

PCT WO 94/06676, entitled "A COVER DEVICE" (international publication date Mar. 31, 1994), describes a cover device comprised of a fastening arch which seems to be secured to the hull of the boat. The fastening arch has coupled thereto a plurality of cover sheets which, when in a non-extracted position, are inside the fastening arch. Some of the cover sheets are adapted to be manually pulled or automatically extracted forward to the front portion of the boat (the visor). The remaining cover sheets are adapted to be manually pulled or automatically extracted rearward to the end of the hull and secured thereto via a strip. In one embodiment of the cover device, the cover sheets can be automatically extracted and retracted by means of a motor or the like.

The device of PCT 94/06676 appears to open and close along an arc thus forming a dome. The dome does not appear to enclose all of the potential "cabin-space" that exists between the stern portion of a flybridge and the stern.

U.S. Pat. No. 4,685,411, issued to Wick, entitled "HATCH FOR BOAT", describes a hatch assembly which is adapted to be slid in and out of the hatch cover. The hatch assembly includes a roof, a hinged front wall and hinged sidewalls. The hatch assembly is described as capable of being slid from three positions. In the first position, the roof is in a retracted position under the hatch cover. Sliding the hatch assembly rearward to the third position allows the hatch assembly to be raised. In other words, as the roof is slid rearward from under the hatch cover, the front wall is capable of being raised so that it becomes vertical. Thereafter, the sidewalls can be pulled out by hand and dropped into a vertical position. In an alternate embodiment, the Wick patent describes the addition of a rear wall. While the Wick patent provides a roof which is slid rearward in substantially the horizontal plane, the arrangement of the hatch assembly requires that the sidewalls, when retracted, be substantially parallel to the horizontal plane and are manually pulled down (rotated) to the vertical plane.

U.S. Pat. No. 5,088,438, issued to Richardson, Jr. et al., entitled "APPARATUS FOR FLEXIBLE MARINE WINDOWS," is primarily directed to an apparatus to prevent singeing of the transparent material forming the windows of a temporary shelter for a marine vessel. However, the Richardson, Jr. et al. patent describes and illustrates the details of the temporary shelter with respect to the rear end of the vessel's hull. The temporary shelter includes a canvas roof and a plurality of side panels having windows, which are capable of being supported by a supporting framework. However, the framework of the Richardson, Jr. et al. appears to be fixed and not deployable. Further, Richardson, Jr. et al. does not describe an automatically deployable enclosure assembly.

U.S. Pat. No. 3,165,762, issued to Hage, entitled "SLIDING TOP" describes a sliding top movable lengthwise of the hull. The sliding top is defined by two U-shaped sections which are slidably engaged with two parallel track formations. It should be further noted that the sliding top, in general, comprises sides having transparent panels; and, that the sides and roof form a unitary piece.

U.S. Pat. No. 1,663,347, issued to Miller, entitled "MARINE VESSEL," describes a marine vessel having a permanent enclosure. This enclosure is described as having a door and a plurality of transparent panels. Miller does not teach deployment or retraction of the enclosure assembly.

U.S. Pat. No. 4,582,016, issued to Hansen, entitled "COLLAPSIBLE FRAME STRUCTURE FOR BOAT ROOF" discloses a collapsible frame structure made of hollow aluminum tubing which is adapted to support a flexible covering to form a convertible top over the cockpit of the boat. The frame structure includes pivotal connections which allow the convertible top to be opened and closed.

U.S. Pat. No. 4,715,312, issued to Bouvart, entitled "CONVERTIBLE CRAFT," discloses a removable stem which is adapted to cover the navigation cabin. The removable stem is coupleable between the visor and the frame.

Japanese Patent No. 55-72490, issued to Yui, entitled "CONFIGURATION ON DECK OF FRP SMALL BOAT" describes and illustrates an enclosure for a deck of a boat.

U.S. Pat. No. 3,857,601, issued to Robbins, entitled "CANOPY FOR PICKUP TRUCKS" describes a canopy for pickup trucks which includes, in general, a unitary structure (defined by a roof and side panels) which is made of a tough, optically transparent plastic. The rear panel includes a hinged swinging window.

There is a need for a retractable/deployable enclosure assembly for use on a watercraft vehicle such as a fishing boat that permits the best of both cruising and fishing and which can be deployed and retracted on-demand, manually or automatically.

Further there is a continuing need to provide a retractable/deployable enclosure assembly which provides a cabin-like area in an otherwise open stern of a vessel.

Moreover, there is a continuing need for a retractable/deployable enclosure assembly which transforms a sport-fishing vessel into a motor yacht vessel on-demand.

As will be seen more fully below, the present invention is substantially different in structure, methodology and approach from that of the prior temporary shelters or enclosures for watercraft vehicles.

SUMMARY OF THE INVENTION

The preferred embodiment of the retractable/deployable enclosure assembly for a watercraft vehicle of the present invention solves the aforementioned problems in a straight forward and simple manner.

Broadly, what is provided is a retractable/deployable enclosure assembly for a watercraft vehicle wherein the watercraft vehicle comprises a cabin, a hull, a gunnel, a stern and a flybridge. The present invention contemplates a retractable/deployable enclosure assembly which comprises: a retractable/deployable roof secured and stored under the flybridge and adapted to be deployed in a horizontal plane therefrom; a plurality of retractable/deployable sidewalls disposed in a vertical plane wherein the plurality of sidewalls has a fully raised position, a partially raised position and a lowered position; and, a hydraulic lift system adapted to lift the plurality of sidewalls vertically to one of the partially raised position and the fully raised position and, alternately, lower the plurality of sidewalls to the lowered position.

The present invention contemplates a retractable/deployable enclosure assembly which comprises a plurality of retractable/deployable sidewalls which comprises: framed sidewall sections in side-by-side relation wherein each framed sidewall section has parallel vertical sides hingedly coupled together via pivot links which sequentially train adjacent framed sidewall section to unfold and lift or, alternately, fold and retract sequentially one-by-one said frame sidewall sections.

The present invention contemplates a retractable/deployable enclosure assembly which comprises a plurality of sidewalls which, automatically on-demand, can be deployed or retracted; a roof which can be deployed or retracted over the sidewalls in synchronization with retraction and deployment of the sidewalls; a sidewall support system adapted to support and, in the case of the automatic embodiment, actually lift the sidewalls into place during deployment.

The present invention further contemplates a retractable/deployable enclosure assembly for a watercraft vehicle which includes foldable or stackable sidewalls wherein each sidewall is independently foldable or stackable and, when deployed, is unfolded or unstacked to maintain a vertically erect sidewall. Moreover, when the enclosure assembly is retracted, the sidewalls collapse (either by folding or stacking) and are tucked away in various recesses in the hull.

The present invention contemplates a retractable/deployable enclosure assembly having a roof which is also concealed or stowed when the enclosure assembly is in its retracted state, slides out of its enclosure assembly to mate with the top of the sidewalls when the enclosure assembly is deployed, and is adapted to fit on top of the sidewalls. In a preferred embodiment, the roof is made of sections which are linked and allow the roof to collapse by the folding or stacking of the various sections.

The present invention contemplates a retractable/deployable enclosure assembly which can be entirely contained within the pre-existing hull of the watercraft vehicle thereby the usable deck area or space is not diminished or compromised.

In view of the above, an object of the present invention is to provide a retractable/deployable enclosure assembly which is designed to provide a cabin-like area in an otherwise open stern of a watercraft vehicle. The cabin-like area can be deployed on demand and, when not needed, can be retracted and tucked away in various recesses in the hull such as under a gunnel cap.

Another object of the present invention is to provide a retractable/deployable enclosure assembly for a watercraft vehicle which is retractable and deployable on-demand either automatically or manually.

A further object of the present invention is to provide a retractable/deployable enclosure assembly for a watercraft vehicle in which the sidewalls and roof can easily collapse or fold into a stowed state for easy and concealed stowage on the boat.

It is a still further object of the present invention to provide an automatically retractable/deployable enclosure assembly for a watercraft vehicle with rigid and non-transparent sidewalls which create a private cabin environment, on-demand, on the vessel.

It is a still further object of the present invention to provide a retractable/deployable enclosure assembly for a watercraft vehicle which allows an otherwise sportfishing boat to function as or be temporarily converted to a leisure or yachting craft with little or no valuable open space sacrificed.

It is a still further object of the present invention to provide a retractable/deployable enclosure assembly for a watercraft vehicle which is preferably sealed so that a cool air environment produced with air conditioning may be maintained within the enclosure assembly.

It is a still further object of the present invention to provide a retractable/deployable enclosure assembly for a watercraft vehicle which would allow at least partial deployment of the sidewalls to provide added protection to prevent young children from falling overboard.

It is a still further object of the present invention to provide a retractable/deployable enclosure assembly for a watercraft vehicle which would allow for deployment of the port and starboard sidewalls with the roof alone and not the rear sidewall in order to permit sheltered fishing in inclement weather.

It is a still further object of the present invention to provide a retractable/deployable enclosure assembly for a watercraft vehicle which provides a temporary enclosure assembly which creates an air conditioned room with a great view of the water.

It is a still further object of the present invention to provide a retractable/deployable enclosure assembly for a watercraft vehicle which provides an enclosure assembly to protect the occupants from adverse weather conditions.

It is a still further object of the present invention to provide a retractable/deployable enclosure assembly for a watercraft vehicle which increases the leisure space on the vessel while maintaining privacy and security.

It is a still further object of the present invention to provide a retractable/deployable enclosure assembly for a watercraft vehicle which increases the environmentally controlled leisure space on the vessel while maintaining sundeck areas (as sun bathers can continue to sun bathe on the deployed roof).

It is a still further object of the present invention to provide a retractable/deployable enclosure assembly for a watercraft vehicle which increases the leisure space on the vessel so as to mitigate "cabin fever" which is prone to occur on long boat rides (especially in rough or rainy weather).

In view of the above objects, it is a feature of the present invention to provide a retractable/deployable enclosure assembly for a watercraft vehicle which can be readily adapted to be installed in the existing fleet of sportfishing boats.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 10:
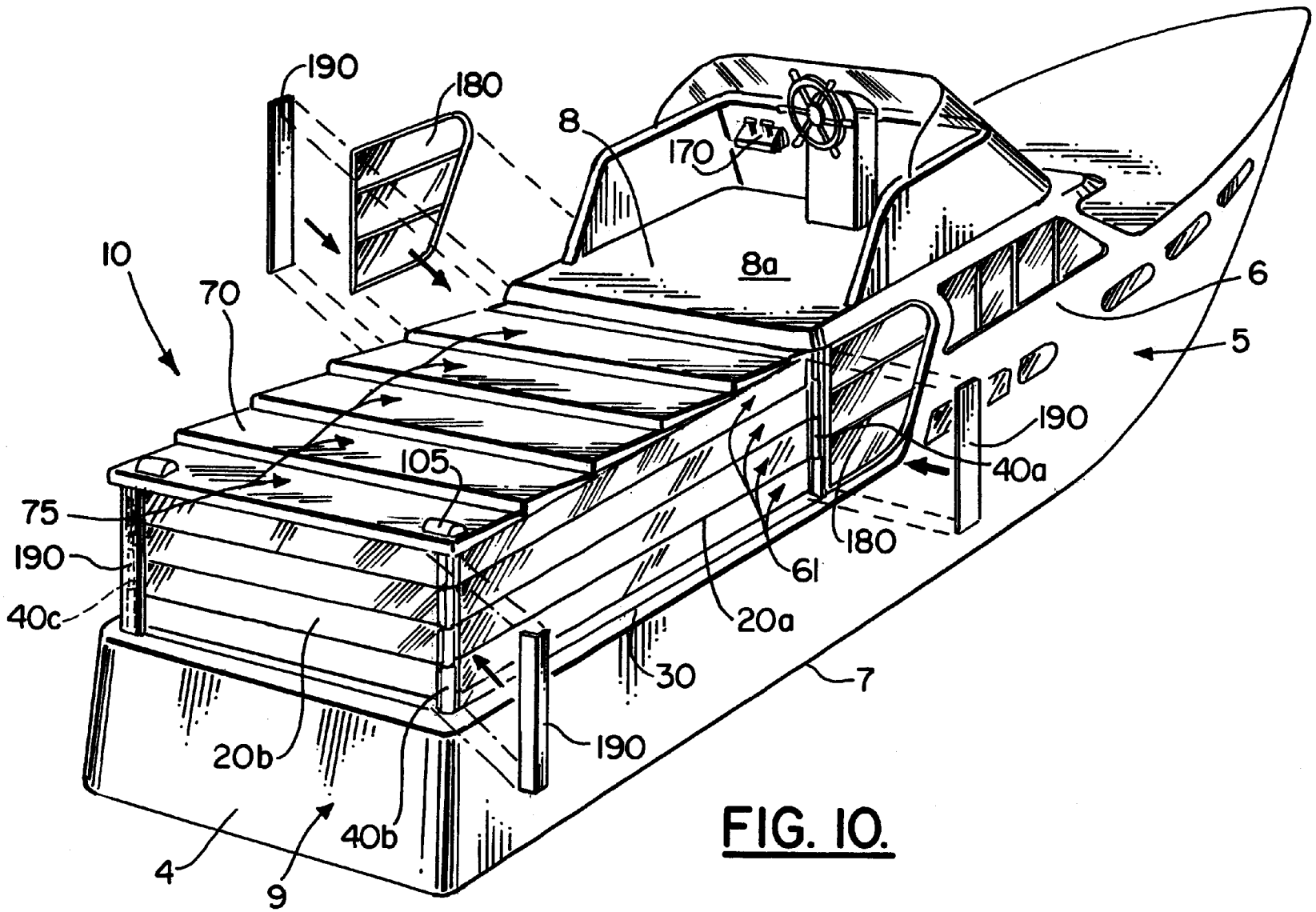
FIG. 10 illustrates a perspective view of the retractable/deployable enclosure assembly of the present invention and the compartment seals.

Referring now to the drawings and in particular FIG. 10, a retractable/deployable enclosure assembly which is automatically retractable/deployable on demand is designated generally by the reference numeral 10 and is designed to be installed on a watercraft vehicle or on an already existing watercraft vehicle 5 which has been adapted for the installation of such. The watercraft vehicle 5 of the exemplary embodiment includes a cabin 6, a hull 7, a flybridge 8 and a stern 9. The flybridge 8 provides an upper deck from which the watercraft vehicle 5 is operated and controlled. The retractable/deployable enclosure assembly 10 encloses the rear-end of the watercraft vehicle 5 from the end of the cabin 6 to the transom 4 of the stern 9.

Figure 13:
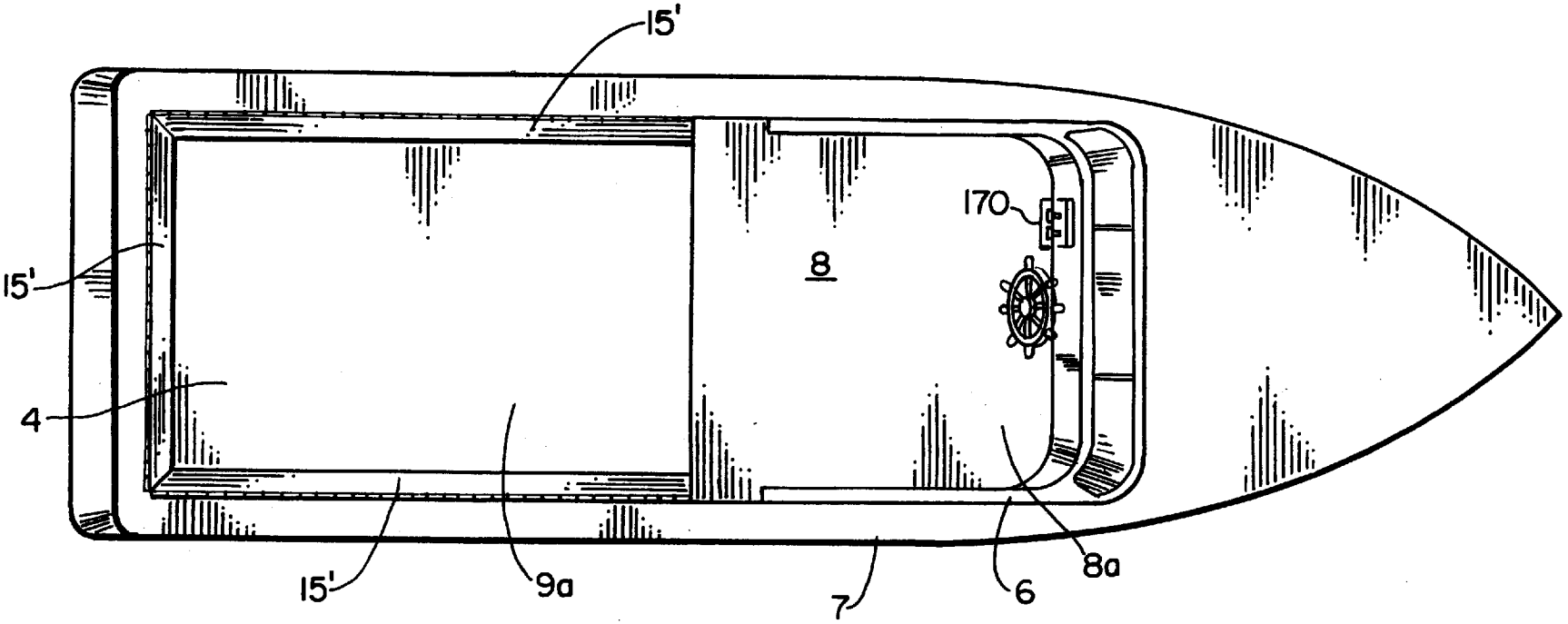

The retractable/deployable enclosure assembly 10, in general, is comprised of three collapsible sidewalls 20*a*, 20*b* and 20*c* and a collapsible roof 70 which are installed in the watercraft vehicle 5. In the preferred embodiment, the three sidewalls 20*a*, 20*b* and 20*c* are positioned, in the retracted state, under the gunnel cap 30, as best seen in FIGS. 1, 2 and 3A–3B or, in an alternative embodiment, in the stern's deck floor 9*a*, as best seen in FIG. 13, which allows for easy and concealed stowage of the retractable/deployable enclosure assembly 10, as well as maximizing both the usable space and the number of passengers able to use the vessel in not only good weather, but also in bad. This ability to increase the usable space in bad weather, in turn, creates another effect, that of alleviating the symptoms of "cabin fever."

Sidewalls

Referring also to FIGS. 1–2, 3A, 3B, 3C, 3D and 5, as the three sidewalls 20*a*, 20*b* and 20*c* are essentially the same, only sidewall 20*a* is herein described in detail. Any differences between the three sidewalls 20*a*, 20*b* and 20*c* are noted. The third sidewall 20*c* shown in FIG. 6 is parallel to sidewall 20*a* and is perpendicular to the other side of sidewall 20*b*.

Figure 1:
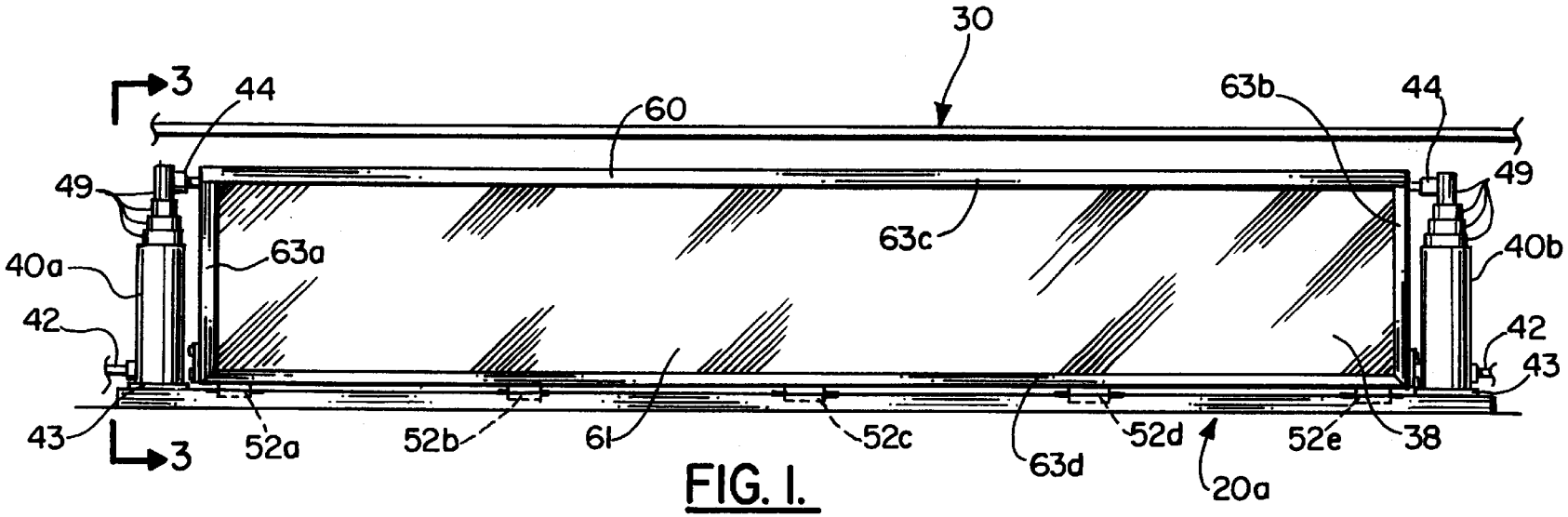
FIG. 1 illustrates a front view of a folded or retracted sidewall of the retractable/deployable enclosure assembly of the present invention fully stowed or retracted within its storage berth (under a gunnel) onboard the watercraft vehicle.
Figure 2:
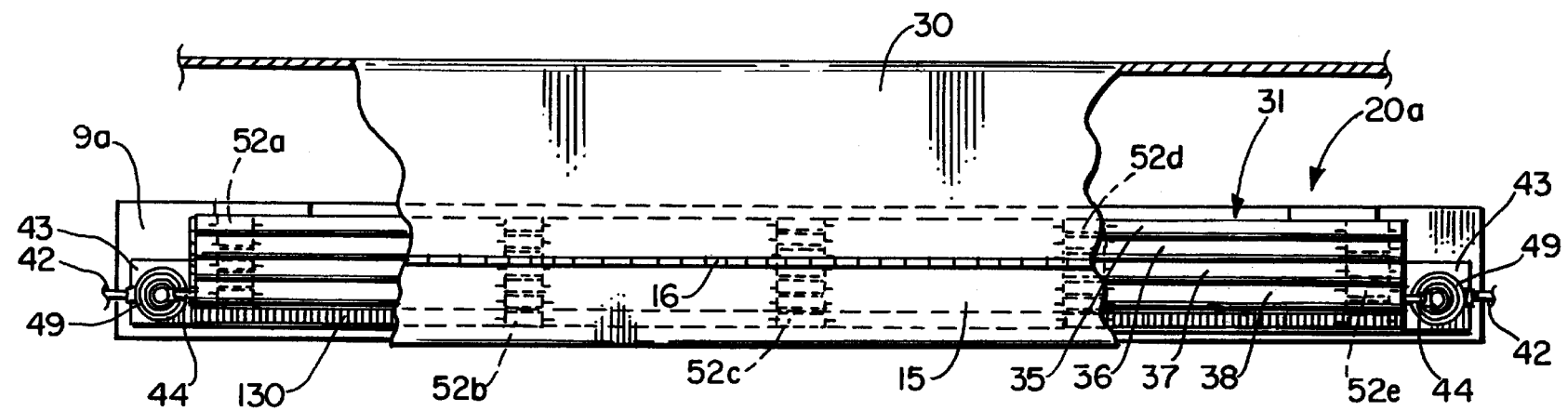
FIG. 2 illustrates a top view of the folded or retracted sidewall of FIG. 1 with the gunnel partially removed.
Figure 3C:
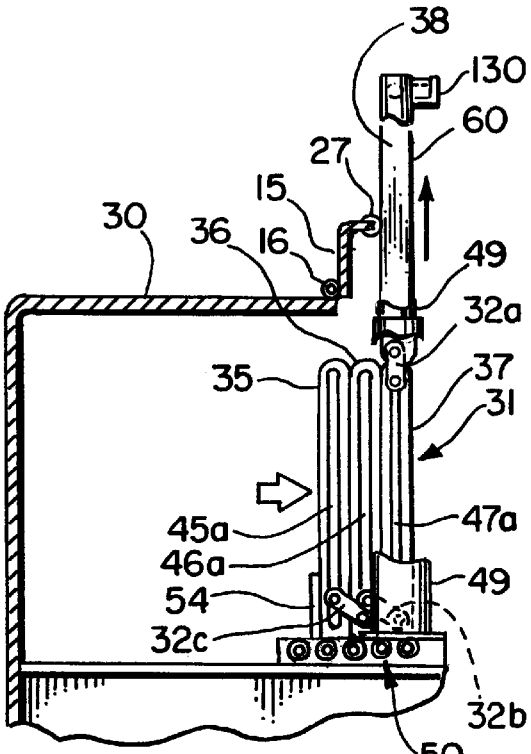
FIG. 3C illustrates an end view of the a partially folded or retracted sidewall section of FIG. 1 being lifted from the lifting point via a hydraulic telescoping lift (partially shown) or being lowered or retracted.

Sidewall 20*a* is comprised of a group of framed sidewall sections 31 horizontally stacked or juxtaposed in a stowed position. When the retractable/deployable enclosure assembly 10 is fully deployed, the group of sidewall sections 31 are vertically stacked or unfolded to form a vertically (partially or fully) erect sidewall 20*a* as best seen in FIGS. 3C and 3D. When the retractable/deployable enclosure assembly 10 is fully retracted, sidewall 20*a* is collapsed or folded such that the group of framed sidewall sections 31 are stowed in a horizontally stacked (juxtaposed) or folded state, as best seen in FIGS. 1, 2 and 3A.

The group of framed sidewall sections 31 are sequentially trained together by a pair of pivoting links 32*a*, 32*b* and 32*c* (only one link of each pair is shown), as best seen in FIGS. 3C and 3D. In the exemplary embodiment, the group of framed and linked sidewall sections 31 for sidewall 20*a* consists of four (4) sidewall sections 35, 36, 37 and 38 to-wit: leading sidewall section 38, trailing sidewall section 35, and first and second intermediate sidewall sections 36 and 37.

While the exemplary embodiment provides for four sidewall sections 35, 36, 37 and 38, any number of sidewall sections may be employed to erect sidewall 20*a*. The height of the group of framed sidewall sections 31 when vertically stacked should substantially reach the plane in which the roof 70 is deployed, as will be described in further detail below.

Referring still to FIGS. 1, 2, 3A–3D and 5, the sidewall sections 35, 36, and 37 are essentially the same and leading sidewall section 38 slightly different. Regarding all sidewall sections 35, 36, 37 and 38 each is comprised of a perimeter frame 60 and a panel or planar member 61. The panel or planar member 61 may be made of fiberglass, glass, plexiglass or any other material (whether rigid, semi-rigid or flexible; and, whether transparent, opaque or non-transparent). Semi-rigid materials may be preferred for the panel or planar member 61 due to the stresses incurred by vehicle or vessel structures in a marine environment and to maintain the integrity and security of the retractable/deployable enclosure assembly 10. The panel or planar member 61 of the sidewall sections 35, 36, and 37 and 38 may have the same or a different kind of materials to form the sidewall 20*a*. For example, the leading sidewall section 38 closest to the roof 70 when deployed could be non-transparent fiberglass while the other first and second intermediate sidewall sections 36 and 37 and trailing sidewall section 35 could be made of a transparent or plexiglass to allow viewing of the seas or harbor.

Each sidewall section 35, 36, 37 and 38 is essentially rectangularly shaped. In the exemplary embodiment, the length of each sidewall section 35, 36, 37 and 38 extends from the substantially the end of the cabin 6 to the transom 4 of the watercraft vehicle 5. The vertical sides of each sidewall section 35, 36, 37 and 38 has a height which is limited to a height which is slightly less than the height of the gunnel cap 30 so that when the sidewall 20*a* is folded, the folded or retracted group of sidewall sections 31 can be tucked away thereunder. On the other hand, the embodiment of FIG. 13 would not generally limit the height of the vertical sides of each sidewall section 35, 36, 37 and 38 to a height which is slightly less than the height of the gunnel cap 30. Instead, the height would be limited to the distance or the clearance available between the stern's deck floor 9*a* and the bottom of the hull 7.

The frame 60 includes two vertical frame members 63*a* and 63*b* and two horizontal frame members 63*c* and 63*d*. The frame 60 of the leading sidewall section 38 of at least the sidewalls 20*a* and 20*c* includes a horizontal track channel 130 positioned along the horizontal frame member 63*c*. The two vertical frame members 63*a* and 63*b* of the trailing sidewall section 35, the first intermediate sidewall section 36 and the second intermediate sidewall section 37 include a slide channel or slot 45*a*, 46*a* and 47*a*, respectively. In the exemplary embodiment, the leading sidewall section 38 does not require such a slide channel or slot.

In a preferred embodiment, the horizontal frame members 63*c* and 63*d* along the top and bottom horizontal edges of a respective one of the sidewall sections 35–38 includes or is made of a rubberized material or sealing material to create a sealing strip 39. Such a sealing strip 39 is adapted to provide a watertight seal between the adjacent sidewall sections of the group of framed sidewall sections 31 when the sidewall 20*a* is deployed and partially or fully erect. It should also be noted that each sidewall 20*a*, 20*b* and 20*c* may be deployed partially to create a form of railing on the watercraft vehicle 5 and not totally enclose the fishing space. This creates a guard against passengers falling overboard. Further, sidewalls 20*a* and 20*c* may be raised separately from sidewall 20*b* and in conjunction with the roof 70 to permit fishing from the rear even in inclement weather.

Each pivotal link of the pairs of pivotal links 32*a*, 32*b* and 32*c* includes a top pivotal end aa and a bottom sliding end bb which is slidably received in a respective one of the slide channels or slots 46*a*, 47*a* and 45*a*. The top pivotal ends aa of the pair of pivotal links 32*a* are pivotally attached in close proximity to a lower end of the two vertical frame members 63*a* and 63*b*, respectively, of the leading sidewall section 38. The bottom sliding ends bb of the pair of pivotal links 32*a* are slidably and pivotally attached in the slots 47*a* of the two vertical frame members 63*a* and 63*b* of the second intermediate sidewall section 37. Thus, the pair of pivotal links 32*a* sequentially train the leading sidewall section 38 with the second intermediate sidewall section 37 in lifting (upward) and lowering (downward) directions. Moreover, the pair of pivotal links 32*a* allows the leading sidewall section 38 and the second intermediate sidewall section 37 to be folded about the pair of pivotal links 32*a*.

The top pivotal ends aa of the pair of pivotal links 32*b* are pivotally attached in close proximity to a lower end of the two vertical frame members 63*a* and 63*b*, respectively, of the second intermediate sidewall section 37. The bottom sliding ends bb of the pair of pivotal links 32*b* are slidably and pivotally attached in the slots 46*a* of the two vertical frame members 63*a* and 63*b* of the first intermediate sidewall section 36. Thus, the pair of pivotal links 32*b* sequentially train the second intermediate sidewall section 37 with the first intermediate sidewall section 36 in lifting (upward) and lowering (downward) directions. Moreover, the pair of pivotal links 32*b* allows the second intermediate sidewall section 37 and the first intermediate sidewall section 36 to be folded about the pair of pivotal links 32*b*.

The top pivotal ends aa of the pair of pivotal links 32*c* are pivotally attached in close proximity to a lower end of the two vertical frame members 63*a* and 63*b*, respectively, of the first intermediate sidewall section 36. The bottom sliding ends bb of the pair of pivotal links 32*c* are slidably and pivotally attached in the slots 45*a* of the two vertical frame members 63*a* and 63*b* of the trailing sidewall section 35. Thus, the pair of pivotal links 32*c* sequentially train the first intermediate sidewall section 36 with the trailing sidewall section 35 in lifting (upward) and lowering (downward) directions. Moreover, the pair of pivotal links 32*c* allows the first intermediate sidewall section 36 and the trailing sidewall section 35 to be folded about the pair of pivotal links 32*c*.

As can be appreciated, the pairs of pivotal links 32*a*, 32*b*, and 32*c* provide hinge mechanisms by which the sidewall 20*a* can be folded or unfolded incrementally, to create a fully or partially erect vertical sidewall.

Figure 3B:
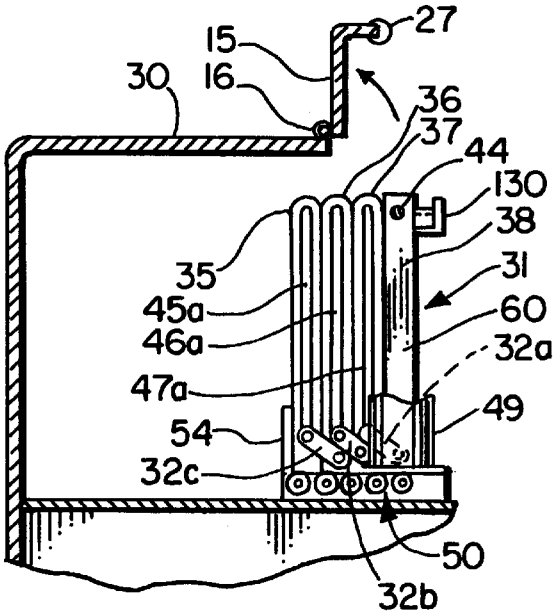
FIG. 3B illustrates an end view of the folded or retracted sidewall of FIG. 1 being moved forward to a lifting point via a rack and pinion assembly of the present invention.
Figure 3A:
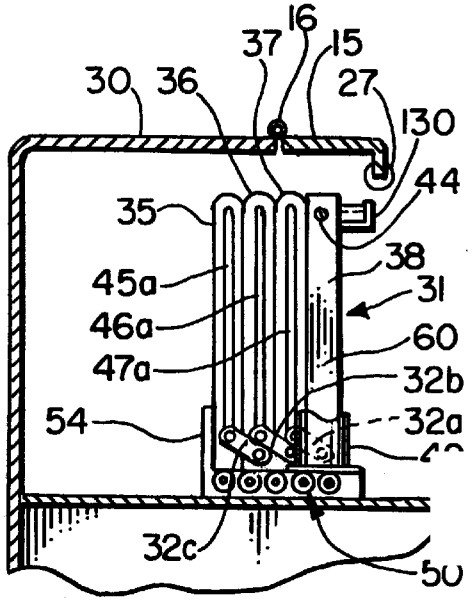
FIG. 3A illustrates an end view of the folded or retracted sidewall of FIG. 1.
Figure 3D:
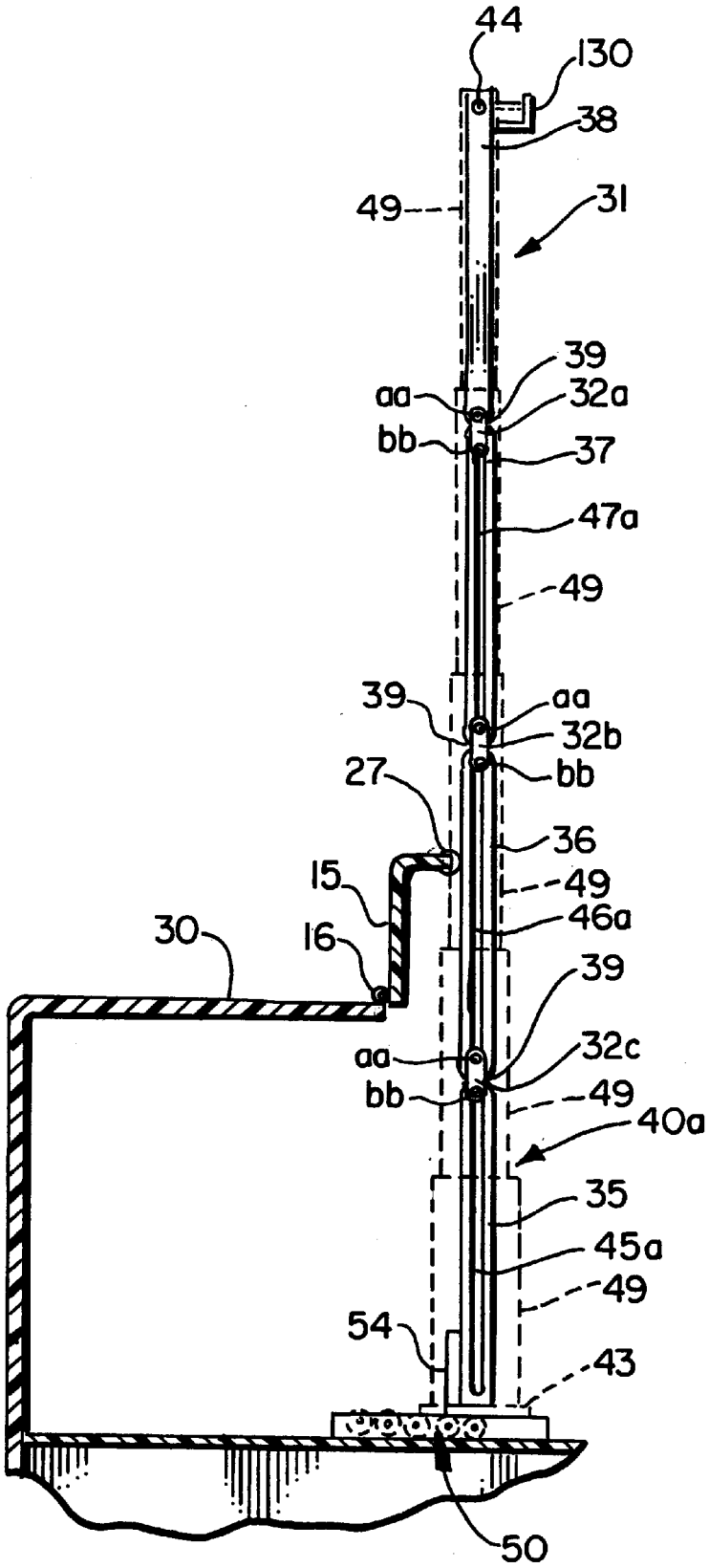
FIG. 3D illustrates an end view of a fully deployed or erect sidewall.

In the retracted state, the group of framed sidewall sections 31 of sidewall 20*a* are horizontally stacked or folded and stowed in a vertical position under the gunnel cap 30, as best seen in FIGS. 3A–3C. In the retracted state, the group of sidewall sections 31 are ready to be deployed by being consecutively lifted and erected to become a vertically erect (partially or fully) sidewall 20*a* as each such sidewall section 38, 37, 36 and 35 is lifted.

The group of framed sidewall sections 31 rest on a roller conveyor belt subassembly 50 comprised of a plurality of spaced roller platforms 52*a*, 52*b*, 52*c*, 52*d* and 52*e* for use in transporting the sidewall sections 37, 36 and 35 to and from the lifting position defined by the pair of hydraulic telescoping lift devices 40*a* and 40*b*, as best seen in FIG. 1 which will be described in detail herein below. The plurality of spaced roller platforms 52*a*, 52*b*, 52*c*, 52*d* and 52*e* each include a movable connecting plate 54 which is affixed to the back side of the trailing sidewall section 35. During lifting movement of the sidewall 20*a*, as the leading sidewall section 38 is being lifted, the plurality of spaced roller platforms 52*a*, 52*b*, 52*c*, 52*d* and 52*e* freely rotate forward or in the direction of the lifting position to eliminate significant friction between the vertical frame member 63*b* of the sidewall sections 35, 36 and 37. However, during lowering movement, the direction of rotation of the plurality of spaced roller platforms 52*a*, 52*b*, 52*c*, 52*d* and 52*e* is controlled so that the movable connecting plate 54 pulls on the trailing sidewall section 35 in order to pull the sequentially trained group of sidewall sections 31 one-by-one under the gunnel cap 30 and out of alignment with the lifting position. The speed of the rotation of the plurality of spaced roller platforms 52*a*, 52*b*, 52*c*, 52*d* and 52*e* is synchronized with the lowering speed of the four (4) hydraulic telescoping lift devices (only 40*a*, 40*b* and 40*c* shown) so that the group of sidewall sections 31 can be sequentially folded and tucked under the gunnel cap 30.

The gunnel cap 30 is modified to include hinged access panels 15 (only one shown) with a sealing strip 27 adapted to provide a watertight seal between the fully deployed sidewalls 20*a*, 20*b* and 20*c* and the gunnel cap 30, as best seen in FIGS. 3C and 3D. The hinged access panels 15 (only one shown) pivots about hinge member 16 to an open position to allow the sidewalls 20*a*, 20*b* and 20*c* to be lifted. In the embodiment of FIG. 13, the sidewalls are deployed through hinged access panels 15' located in the stern's deck floor 9*a*, the hinged access panels 15' also further comprise a sealing strip (NOT SHOWN) adapted to provide a watertight seal between the stern's deck floor 9*a* and sidewalls thereby allowing efficient climate, such as air conditioning and heating, in the retractable/deployable enclosure assembly 10 provided the watercraft vehicle 5 is equipped with an air conditioning and heating system.

The sidewall 20*a* is deployed and erected by a pair of hydraulic telescoping lift devices 40*a* and 40*b*, as best seen in FIG. 1, which lifts one-by-one the group of framed (sequentially trained) sidewall sections 31 of sidewall 20*a*, as the pair of hydraulic telescoping lift devices 40*a* and 40*b* telescope upward to their full height. The pair of hydraulic telescoping lift devices 40*a* and 40*b* is synchronized to lift simultaneously and at the same speed. Furthermore, the pair of hydraulic telescoping lift devices 40*a* and 40*b* is synchronized to partially telescope upward to partially raise vertically the sidewall 20*a*.

The three sidewalls 20*a*, 20*b* and 20*c* are lifted via two pairs of or four (4) hydraulic telescoping lift devices (only 40*a*, 40*b* and 40*c* shown in FIG. 10). The fourth hydraulic telescoping lift device is positioned directly across from the hydraulic telescoping lift devices only 40*a* and functions in a similar manner. The hydraulic telescoping lift device 40*b* is shared by the sidewalls 20*a* and 20*b*. The hydraulic telescoping lift device 40*c* is shared by the sidewalls and 20*b* and 20*c*.

Figure 5:
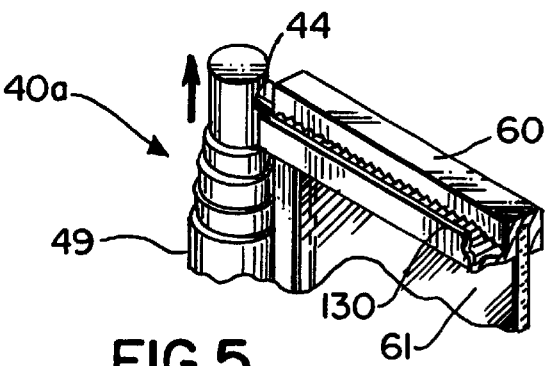
FIG. 5 illustrates a partial perspective view of a top or upper framed sidewall panel of the sidewall and its connection to the hydraulic telescoping lift and roof.
Figure 6:
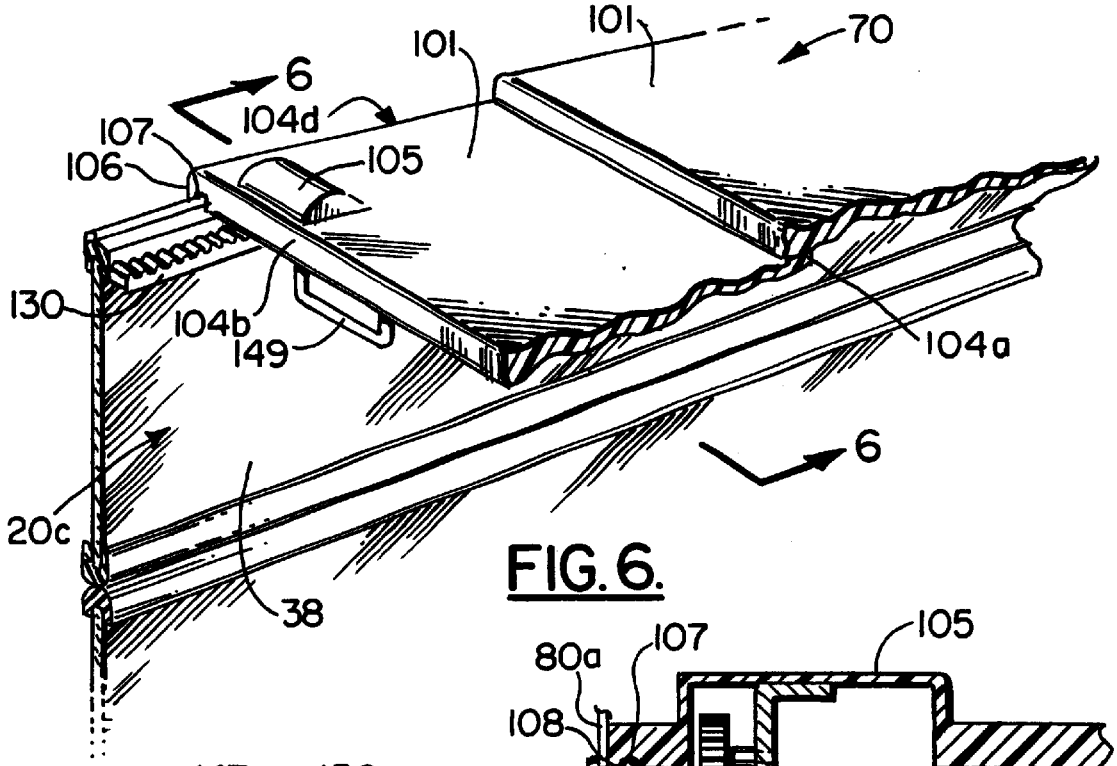
FIG. 6 illustrates a partial elevational view from a first side of a first embodiment of the roof designed for manual deployment.

Referring now to FIGS. 1 and 5, each pair of hydraulic telescoping lift device (40*a* and 40*b*) is feed by line 42 and is coupled to the frame 60 of the leading sidewall section 38 via lifting pins 44 along horizontal members 63*c* and 63*d*, respectively, in close proximity to the upper end thereof. Each hydraulic telescoping lift device 40*a*, 40*b* and 40*c* includes a support base 43 affixed to the stern's deck floor 9*a* in alignment with the lifting position and a plurality of telescopically mated sections 49.

During lifting operation, the plurality of telescopically mated sections 49 telescope upwardly (partially or fully) and, during lowering operations, a plurality of telescopically mated sections 49 collapse. In the preferred embodiment, the hydraulic telescoping lift device 40*a*, 40*b* and 40*c* in a collapsed state, as best seen in FIG. 1 has a height which can be accommodated under the gunnel cap 30.

In operation, when the access panel 15 of the gunnel cap 30 is raised, the leading sidewall section 38, when observed, is stored and aligned with the lifting position and is ready to be deployed or raised by the pair of hydraulic telescoping lift device 40*a* and 40*b*. As the leading sidewall section 38 is lifted upward from the lifting position, each sequentially trained sidewall sections 35–37 is sequentially lifted.

In an alternate embodiment, in lieu of the frame 60, the panel or planar member 61 would have formed or integrated therein the slide channel or slot 45*a*, 46*a* or 47*a* and would have the necessary holes and pins for interconnecting the pairs of pivotal links 32*a*, 32*b*, and 32*c*.

In a still further alternate embodiment, the frame 60 of any two adjacent sidewall sections could be designed to provide mating for a more secure stacking and weatherizing. For example, the horizontal frame members 63*c* along the top horizontal edges of a respective one of the sidewall sections 35–38 would be concaved while the horizontal frame members 63*d* along the bottom horizontal edges of a respective one of the sidewall sections 35–38 would be convexed. The convexed horizontal frame members 63*d* would be contoured to receive the concaved horizontal frame members 63*c* of a lower sidewall section. In operation, when deploying the sidewalls 20*a*, 20*b* and 20*c* fully, the hydraulic telescoping lift devices (only 40*a*, 40*b* and 40*c* shown) would first lift the sidewall sections 35–38 so that a slight gap would be provide between adjacent sidewall sections so that the concaved horizontal frame members 63*c* can be aligned with the convexed horizontal frame members 63*d*. Thereafter, the sidewall sections 35–38 would be lowered so that the concaved horizontal frame members 63*c* can be seated in the convexed horizontal frame members 63*d*.

In a still further embodiment, the retractable/deployable enclosure assembly would allow for deployment of the port and starboard sidewalls 20*a* and 20*c* with the roof 70 alone and not the sidewall 20*b* in order to permit sheltered fishing in inclement weather. In such an embodiment, each sidewall would require their own pair of hydraulic telescoping lift devices with no sharing. Alternately, if the hydraulic telescoping lift devices (only 40*a*, 40*b* and 40*c* shown) were shared, the lifting pins 44 coupled to the sidewall 20*c* would be temporarily removed so that as the hydraulic telescoping lift devices 40*b* and 40*c* telescoped, only the port and starboard sidewalls were deployed.

Roof

Figure 4:
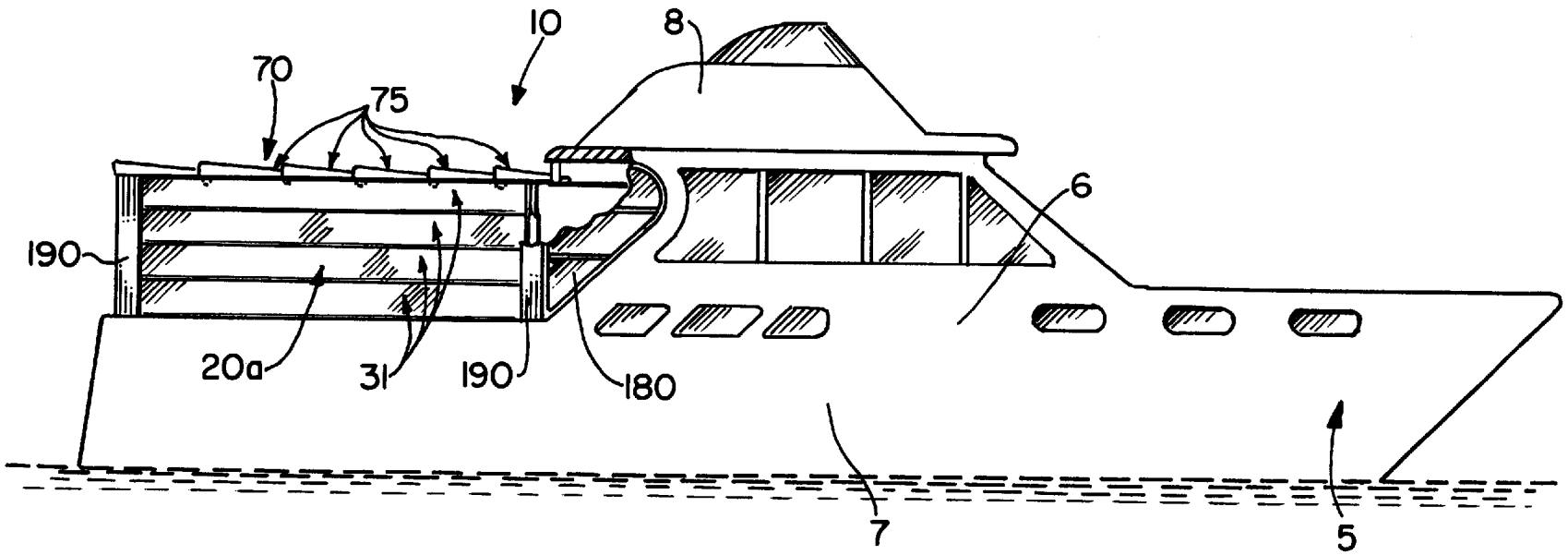
FIG. 4 illustrates a side view of the retractable/deployable enclosure assembly with the compartment seals of the present invention deployed on a watercraft vehicle.

As seen in FIGS. 4 and 10, after deployment of the sidewalls 20*a*, 20*b* and 20*c*, a roof 70 comprising a plurality of roof sections 75 may be deployed from the flybridge deck 8*a*. The plurality of roof sections 75 are preferably stored in a storage berth 90 located under the flybridge deck 8*a* or the storage berth may comprise a hollowed out section of the flybridge deck 8*a*. The plurality of roof sections 75 are adapted to horizontally unfold to form a horizontally erect roof 70, as best seen in FIGS. 4 and 10. The horizontally erect roof 70 may serve as a sundeck or added walking space from the flybridge deck 8*a*.

The storage berth 90 comprises a shelf 92 suspended from the underside of the flybridge deck 8*a* via a plurality of support brackets 94 (only two shown). The shelf 92 is suspended at a distance below the underside of the flybridge deck 8*a* to accommodate the stacked or folded plurality of roof sections 75.

When the roof 70 is fully retracted in the storage berth 90, the roof 70 is collapsed or folded such that the plurality of roof sections 75 are stowed in a vertically stacked or folded state. The plurality of roof sections 75 are sequentially entrained together by pivoting links 80*a*, 80*b*, 80*c* and 80*d* in a manner which is similar to the group of sidewall sections 31.

In the exemplary embodiment, there are five (5) roof sections in the plurality of roof sections 75, to-wit: leading roof section 71, trailing roof section 76, and three intermediate roof section, namely first intermediate roof section 72, second intermediate roof section 73, and third intermediate roof section 74. The number and length of roof sections in the plurality of roof sections 75 depend upon the length of the roof 70 to extend to the sidewall 20*b* positioned along the transom 4 and the depth of the storage berth 90 underneath the flybridge deck 8*a*.

Referring now to FIGS. 4, 6, 9, 10 and 11, each roof section 72–74 are essentially the same and leading and trailing roof sections 71 and 76 slightly different. Regarding all roof sections 71–74 and 76, each is comprised of a panel or planar member 101 which may be made of fiberglass, glass, plexiglass or any other material (whether rigid, semi-rigid or flexible; and, whether transparent, opaque or non-transparent). Semi-rigid materials may be preferred for the panel or planar member 101 due to the stresses incurred by vehicle or vessel structures in a marine environment and to maintain the integrity and security of the retractable/deployable enclosure assembly 10.

With reference to FIGS. 6, 7, 8 and 9, the panel or planar member 101 includes two parallel long sides 104*a* and 104*b* and two sidewall (short) sides 104*c* and 104*d* wherein the sidewall sides 104*c* and 104*d* have a triangularly-shaped profile. In the embodiment of FIGS. 4 and 10, the two parallel long sides 104*a* and 104*b* have different widths to define the triangularly-shaped profile. Side 104*a* is thicker than sidewall 104*b*.

The leading roof section 71 includes a alcove 105 in close proximity to the forward corners of the leading roof section 71 for receipt of a motor device 150 to rotate the pinion 147, as will be describe in more detail later. The two sidewall (short) sides 104*c* and 104*d* of all roof sections 71–74 and 76 includes a flange 106 which extends over or overlaps onto the horizontal frame member 63*a* of the leading sidewall section 38 of sidewalls 20*a* and 20*c* to waterproof the roof 70 therealong.

The two sidewall sides 104*c* and 104*d* of the trailing roof section 76 and the intermediate sidewall sections 72–74 include a slide channel or slot 112*a*, 113*a*, 114*a* and 116*a*, respectively. In the exemplary embodiment, the leading roof section 71 does not require such a slide channel or slot although shown.

Each pivotal link of the pairs of pivotal links 80*a*, 80*b*, 80*c* and 80*d* includes a forward pivotal end xx and a rear sliding end zz which is slidably received in a respective one of the slide channels or slots 112*a*, 113*a*, 114*a* and 116*a*.

The forward pivotal ends xx of the pair of pivotal links 112*a* are pivotally attached in close proximity to a rear end of the two sidewall sides 104*c* and 104*d*, respectively, of the leading roof section 71. The rear sliding ends zz of the pair of pivotal links 80*a* are slidably and pivotally attached in the slots 112*a* of the two sidewall sides 104*c* and 104*d* of the first intermediate roof section 72. Thus, the pair of pivotal links 80*a* sequentially train the leading roof section 71 with the first intermediate roof section 72 as the leading roof section 71 is propelled forward in the direction of the stern or transom 4 or retracted in the direction of the flybridge 8. Moreover, the pair of pivotal links 80*a* allows the leading roof section 71 and the first intermediate sidewall section 72 to be folded about the pair of pivotal links 80*a*.

The forward pivotal ends xx of the pair of pivotal links 80*b* are pivotally attached in close proximity to a rear end of the two sidewall sides 104*c* and 104*d*, respectively, of the first intermediate roof section 72. The rear sliding ends zz of the pair of pivotal links 80*b* are slidably and pivotally attached in the slots 113*a* of the two sidewall sides 104*c* and 104*d* of the second intermediate roof section 73. Thus, the pair of pivotal links 80*b* sequentially train the first intermediate roof section 72 with the second intermediate roof section 73 in the forward direction toward the stern or transom 4 or in the rearward direction toward the flybridge 8. Moreover, the pair of pivotal links 80*b* allows the first intermediate sidewall section 72 and the second intermediate sidewall section 73 to be folded about the pair of pivotal links 80*b*.

Since, the sequential training operation for each subsequent roof section is essentially identical no further discussion would be had. Furthermore, the sequential training operation was described in full detail with regard to the plurality of sidewall sections 31. As can be appreciated, the pairs of pivotal links 80*a*, 80*b*, 80*c* and 80*d* provide hinge mechanisms by which the roof 70 can be folded or unfolded incrementally, to create a fully or partially deployed roof 70.

Figure 11:
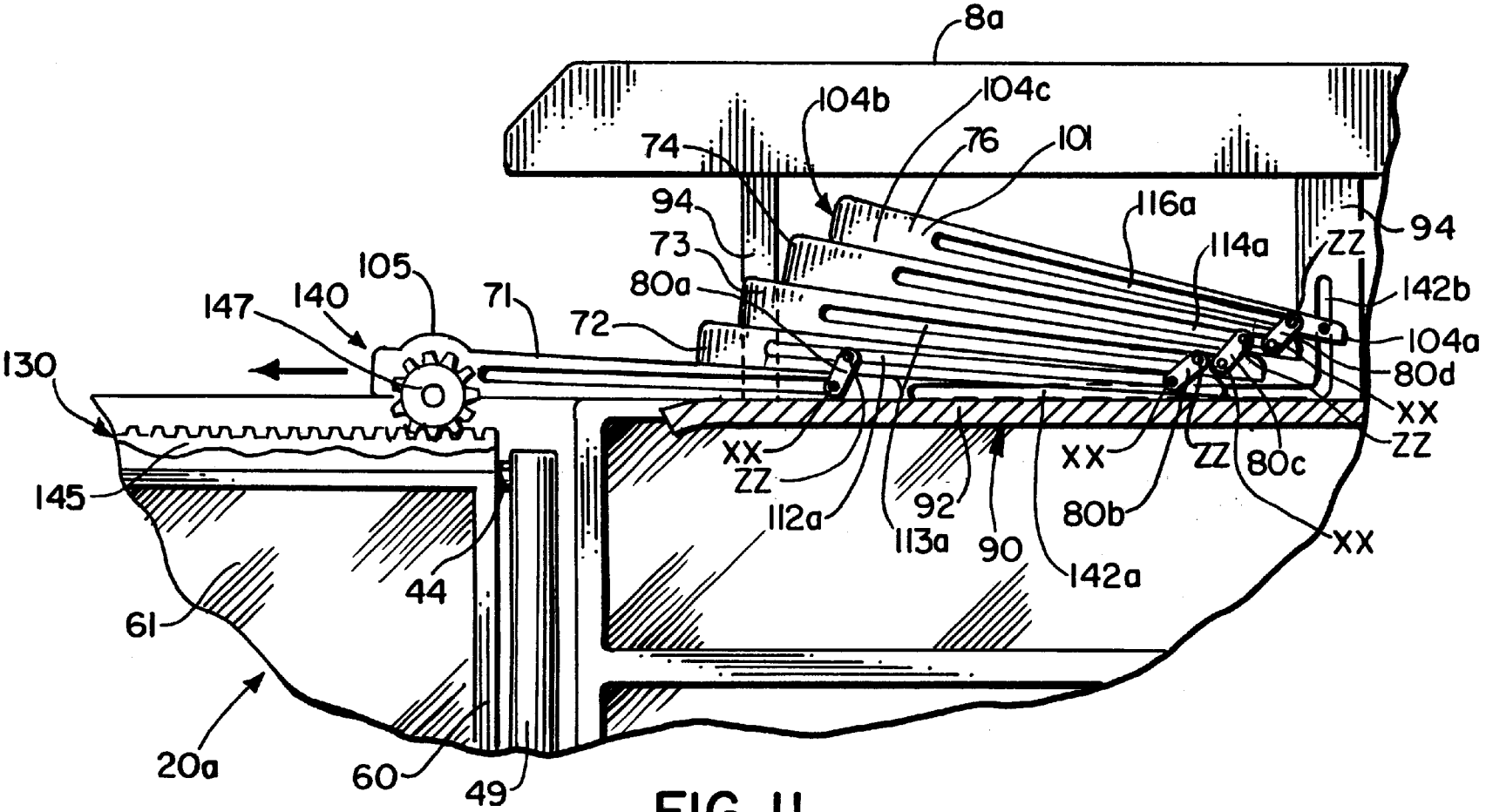
FIG. 11 illustrates an end view of the roof and the roof's storage berth in the collapsed or retracted state.

As seen in FIG. 11, in the retracted state, the plurality of roof sections 75 of the roof 70 are stacked or folded and stowed in a vertically stacked position under the flybridge deck 8*a* in the storage berth 90. In the retracted state, the plurality of roof sections 75 are ready to be deployed by being consecutively pulled and erected to become a horizontally erect roof 70 as each sequentially trained roof sections 71–74 and 76 is consecutively pulled into place by the rack and pinion assembly 140.

The rack and pinion assembly 140 comprises a limiting subassembly 142, rack 145 and pinion or toothed cog 147. The limiting subassembly 142 includes a free sliding L-shaped member having a first section 142*a* and a second section 142*b* perpendicularly coupled to the first section 142*a*. The first section 142*a* is slidably coupled to the top side of shelf 92 of the storage berth 90. The trailing roof section 76 is coupled to the second section 142*b* wherein the second section 142*b* serves as a stop or limit to limit the forward pull of the plurality of roof sections 75 by the rack and pinion assembly 140. In operation, the limiting subassembly 142 limits the distance the trailing roof section 76 can move forward and rearward.

The adjacent roof sections overlap, as best seen in FIG. 10. Thus, as the roof sections are retracted, the pinion 147 rotates over the rack 145 first moving the leading roof section 71 rearward. As the leading roof section 71 moves rearward, the first intermediate roof section 72 slides on top of the leading roof section 71 by virtue of the sequentially trained functionality. Furthermore, as the first intermediate roof section 72 in combination with the leading roof section 71 slides rearward the second intermediate roof section 73 slides on top of the first intermediate roof section 72. Thus, the roof sections 71–73 become automatically stacked and folded as they are being retracted.

Subsequently, as stacked roof sections 71–73 slide rearward, the third intermediate roof section 74 slides on top of the second intermediate roof section 73. Finally, as the stacked roof sections 71–74 slide rearward, the trailing roof section 76 slides on top of the third intermediate roof section 74 and becomes stacked thereon. Additionally, as the trailing roof section 76 slides on top of the third intermediate roof section 74, the first section 142*a* slides rearward on the top side of the shelf 92 until the stacked roof sections 71–74 and 76 are fully received under the flybridge 8 and in the storage berth 90, as best seen in FIG. 11.

In operation, the roof 70' and the sidewalls 20*a*, 20*b* and 20*c* are deployed electronically under control panel 170 positioned at the flybridge 8. Another control panel may be position in the cabin 6. Preferably, the roof 70' may not be deployed absent full deployment of at least the port and starboard sidewalls 20*a*, 20*c* because of the roof's need for support. Roof 70 when manually deployed should not be deployed until the port and starboard sidewalls 20*a*, 20*c* are deployed. As can be appreciated, the sidewalls 20*a*, 20*b* and 20*c* may be manually deployed. However, this totally manual embodiment may be combined with the completely mechanized and automatic embodiment to create an embodiment that is both manual and automatic which allows use of the retractable/deployable enclosure assembly even in the result of a power loss.

Figure 7:
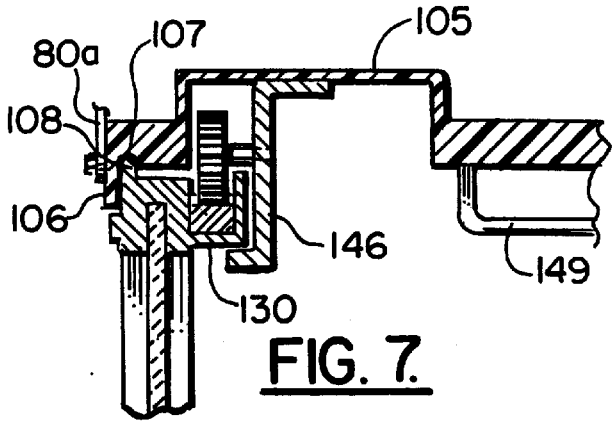
FIG. 7 illustrates a cross sectional view along the plane 6—6 of the embodiment of FIG. 6.

Referring now to FIGS. 6 and 7, a first embodiment of the roof is shown. In this embodiment, the roof is deployed manually via at least one handle 149 positioned along the forward end of the leading roof section 71. The pinion or toothed cog 147 is supported by a bracket member 146 having one end coupled to the alcove 105. The other end rides under the horizontal rack channel 130. In this embodiment, a channel guide 107 is formed in an underside of the panel or planar member 101 and which is parallel to sidewall side 104*d*. Likewise, a channel guide is provided parallel to sidewall 104*c* although not shown. In this embodiment, the horizontal frame member 63*c* include a projection 108 arranged to be received in the channel guide 107.

Figure 9:
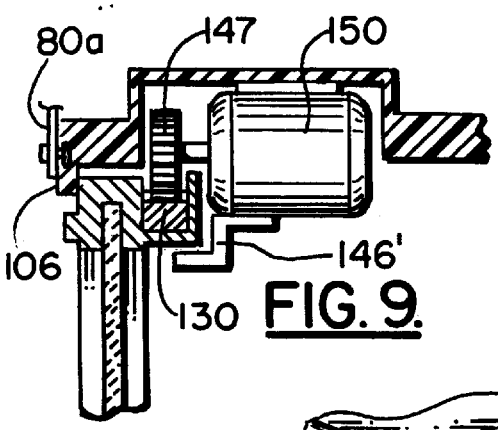
FIG. 9 illustrates a cross sectional view along the plane 8—8 of the embodiment of FIG. 8.
Figure 8:
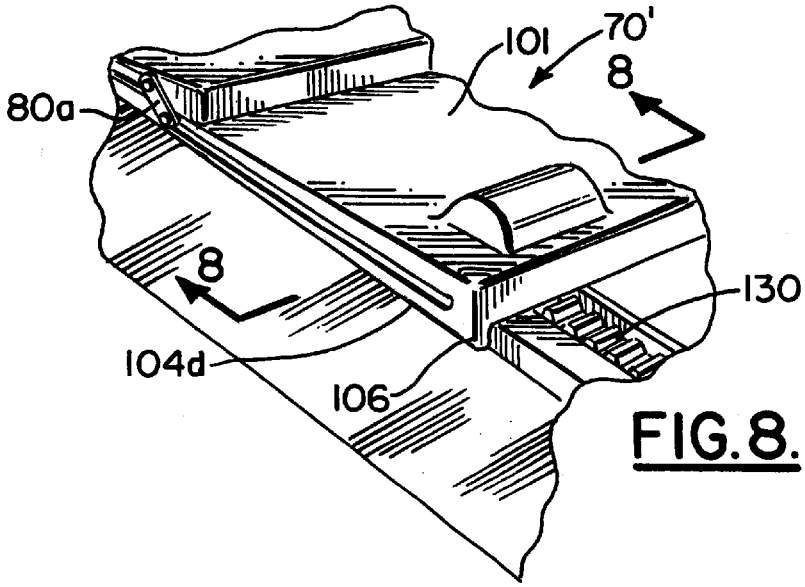
FIG. 8 illustrates a partial elevational view from a first side of a second embodiment of the roof designed for automatic deployment.

Referring now to FIGS. 8 and 9, a second embodiment of the roof is shown. In this embodiment, the roof 70' is deployed automatically wherein the pinion or toothed cog 147 is rotated under the control of motor 150. The motor 150 is supported in the alcove 105 via bracket member 146' which has one end affixed to the motor 150 and another end positioned to ride under the horizontal rack channel 130.

Figure 12:
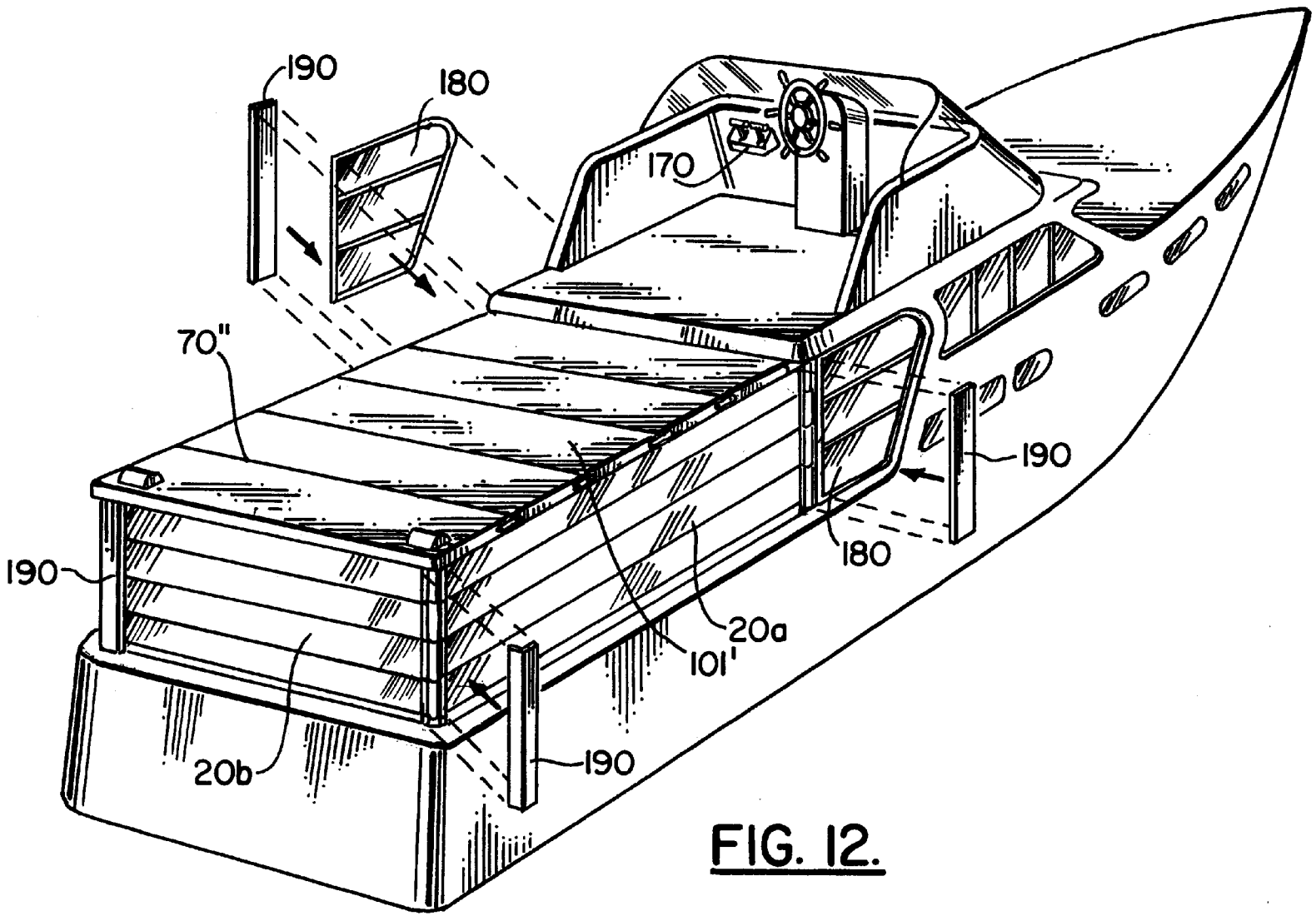
FIG. 12 illustrates a perspective view of an alternate embodiment of the retractable/deployable enclosure assembly with an uniformly flat roof deployed on the watercraft vessel; and, FIG. 13 illustrates a top view of the watercraft vessel and the location of the access ports for storage of the enclosure assembly's sidewall sections underneath the deck of the watercraft vessel.

Referring now to FIG. 12, a still further alternate embodiment of the roof 70" is shown. The roof 70" comprises a generally flat surface wherein the panel or planar member 101' has a rectangular profile and not a triangularly profile. The flat surface enables the users to sunbathe or perform other activities on the roof 70" if desired.

Referring now to FIGS. 4 and 10, the retractable/deployable enclosure assembly 10 may still fail to completely enclose all of the openings in a watercraft vehicle 5 due to variety of hull 7 and cabin 6 designs available to consumers today. Thus, the retractable/deployable enclosure assembly 10 further comprises accessory seals. The accessory seals are of two types, cabin seals 180 and hydraulic lift seals 190. Both the cabin seals 180 and the hydraulic lift seals 190 may be used through manual insertion either from the outside of the retractable/deployable enclosure assembly 10 or from the inside of the retractable/deployable enclosure assembly 10. Cabin seals 180 are adapted to enclose the areas not enclosed by the retractable/deployable enclosure assembly 10 due to the cabin design. An example of such would be the void left by the downward sweep of a flybridge 8 that leaves an opening between the cabin 6 and the flybridge 8.

The hydraulic lift seals 190 are adapted to cover the hydraulic telescoping life devices (only 40*a*, 40*b* and 40*c* shown) used to lift the sidewalls 20*a*, 20*b* and 20*c* in order to minimize leakage of cool air from the retractable/deployable enclosure assembly 10. The cabin seals 180 and the hydraulic lift seals 190 both provide a weather resistant and water tight seal in order to further facilitate the maintenance of a uniform temperature in the retractable/deployable enclosure assembly 10.

Thus, the cabin seals 180 and the hydraulic lift seals 190 in conjunction with the sidewalls 20*a*, 20*b* and 20*c* and the roof 70 allows for a fishing vessel or any unenclosed nautical space to be transformed into a pleasure yacht with all of the amenities of such through the use of an retractable/deployable enclosure assembly 10 stowed in a minimal space in such a fashion that allows maximum space for both leisure and fishing activities.

It is noted that the embodiment of the retractable/deployable enclosure assembly described herein in detail, for exemplary purposes, are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An retractable/deployable enclosure assembly for a watercraft vehicle wherein said watercraft vehicle comprises a cabin, a hull, a gunnel, a stern and a flybridge, said enclosure assembly comprising:

a plurality of retractable/deployable sidewalls disposed in a vertical plane wherein said plurality of sidewalls has a fully raised position, a partially raised position and a lowered position;

a hydraulic lift system adapted to lift said plurality of sidewalls vertically to one of said partially raised position and said fully raised position and, alternately, lower said plurality of sidewalls to said lowered position; and a retractable/deployable roof secured and store under said flybridge and deployed in a horizontal plane therefrom on along a top edge of two parallel sidewalls of said plurality of retractable/deployable sidewalls when in said fully raised position.

2. The enclosure assembly of claim 1, wherein said plurality of retractable/deployable sidewalls are automatically deployed.

3. The enclosure assembly of claim 2, wherein each sidewall of said plurality of retractable/deployable sidewalls comprises:

sidewall sections in side-by-side relation wherein each sidewall section has parallel vertical sides hingedly coupled together via pivot links which sequentially train adjacent sidewall section to unfold and lift to said fully raised position or said partially raised position or, alternately, fold and retract sequentially one-by-one from said fully raised position or said partially raised position.

4. The enclosure assembly of claim 3, wherein said sidewall sections are constructed and arranged when folded to be stored in a storage berth under said gunnel; and further comprising:

a roller conveyor belt system in said storage berth which rolls under said sidewall sections to provide minimize friction therebetween as the sidewall sections are pulled and unfolded from said storage berth.

5. The enclosure assembly of claim 4, wherein said gunnel further comprises a hinged access panel which opens to permit the deployment of said sidewall sections from said storage berth.

6. The enclosure assembly of claim 5, wherein said access panel comprises:

an L-shaped member hinged coupled to said gunnel; and, a sealing strip coupled to a free edge of said L-shaped member which engages at least one sidewall section when in said partially raised position or said fully raised position to create a substantially watertight seal.

7. The enclosure assembly of claim 3, wherein said sidewall sections are constructed and arranged when folded to be stored in a storage berth under a stern's deck floor.

8. The enclosure assembly of claim 2, wherein each sidewall section comprises:

a frame having two parallel horizontal frame members and two parallel vertical frame members;

a planar substrate having said frame coupled around the edges thereof;

a first elongated slot formed in one of said two parallel vertical frame members; and, a second elongated slot formed in the other of said two parallel vertical frame members;

and wherein each sidewall of said plurality of retractable/deployable sidewalls comprises pairs of pivot links each pair having top ends each of which is pivotally coupled to a respective one of said two parallel vertical frame members of a first sidewall section of two adjacent sidewall sections and bottom ends each of which is pivotally and slidably received in a respective one of said first and second elongated slots of the other sidewall section of said two adjacent sidewall sections.

9. The enclosure assembly of claim 8, wherein said frame further comprises a sealing strip along at least one horizontal frame member.

10. The enclosure assembly of claim 9, wherein said sealing strip forms a watertight seal between adjacent sidewall sections when in said fully raised position or said partially raised position.

11. The enclosure assembly of claim 3, wherein at least one sidewall section is made of transparent material.

12. The enclosure assembly of claim 1, wherein said hydraulic lift system comprises a plurality of telescoping sidewall hydraulic lift assemblies with lifting pins connected to a leading sidewall section of each sidewall of said plurality of retractable/deployable sidewalls.

13. The enclosure assembly of claim 1, wherein said retractable/deployable roof is automatically deployable.

14. The enclosure assembly of claim 13, wherein said retractable/deployable roof comprises:

a plurality of horizontal roof sections wherein adjacent roof sections are hingedly coupled together and adapted to be deployed slightly overlapping.

15. The enclosure assembly of claim 14, wherein each roof section of said plurality of horizontal roof sections comprises:

a planar substrate having two parallel long sides and two parallel short sides;

a first elongated slot formed in one of said two parallel short sides; and, a second elongated slot formed in the other of said two parallel short sides;

and wherein said retractable/deployable roof further pairs of pivot links each pair having forward ends each of which is pivotally coupled to a respective one of said two parallel short sides of a first roof section of two adjacent roof sections and bottom ends each of which is pivotally and slidably received in a respective one of said first and second elongated slots of the other roof section of said two adjacent roof sections.

16. The enclosure assembly of claim 15, wherein:

a leading sidewall section of each sidewall of said plurality of retractable/deployable sidewalls comprises a top mounted horizontal channel having a rack formed therealong; and a leading horizontal roof section of said plurality of horizontal roof sections comprises a pinion or toothed cog capable of mating with said rack to roll said leading horizontal roof section along said rack to said transom.

17. The enclosure assembly of claim 16, wherein as said pinion or said toothed cog rolls toward said transom, said plurality of horizontal roof sections hingedly coupled together via said pairs of pivot links are sequentially trained to unfold one-by-one.

18. The enclosure assembly of claim 17, wherein:

said leading horizontal roof section has formed in forward corners thereof alcoves; and, said retractable/deployable roof further comprises a motor supported in said alcove and coupled to said pinion or said toothed cog.

19. The enclosure assembly of claim 18, further comprising:

at least one control panel electrically coupled to said motor and said hydraulic lift system to retract and, alternately, deploy said retractable/deployable roof and said plurality of retractable/deployable sidewalls.

20. The enclosure assembly of claim 14, wherein at least one horizontal roof section is made of transparent material.

* * * * *